US006520743B2

(12) United States Patent
Arilla et al.

(10) Patent No.: US 6,520,743 B2
(45) Date of Patent: Feb. 18, 2003

(54) ROTOR BLADE RETAINING APPARATUS

(75) Inventors: Jean-Baptiste Arilla, Saragossa (ES); Jean-Philippe Maffre, Dammarie les Lys (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 09/907,679

(22) Filed: Jul. 19, 2001

(65) Prior Publication Data

US 2002/0018719 A1 Feb. 14, 2002

(30) Foreign Application Priority Data

Aug. 10, 2000 (FR) ..... 00 10503

(51) Int. Cl.[7] ..... B63H 1/20

(52) U.S. Cl. ..... 416/220 R; 416/204 A; 416/244 A

(58) Field of Search ..... 416/220 R, 221, 416/204 A, 244 A

(56) References Cited

U.S. PATENT DOCUMENTS 3,768,924 A * 10/1973 Corsmeier et al. ..... 416/95
4,192,633 A * 3/1980 Herzner ..... 416/221
4,304,523 A * 12/1981 Corsmeier et al. ..... 416/221
4,890,981 A * 1/1990 Corsmeier et al. ..... 416/220 R
5,018,943 A * 5/1991 Corsmeier et al. ..... 416/144
5,525,429 A * 6/1996 Mannava et al. ..... 428/610

* cited by examiner

*Primary Examiner*—Edward K. Look
*Assistant Examiner*—James M McAleenan
(74) *Attorney, Agent, or Firm*—Bacon & Thomas, PLLC

(57) ABSTRACT

An apparatus for axially retaining rotor blades to an annular radially extending disk having a recess and a flange. An annular retaining ring is disposed in the recess and includes an axially extending lip and an axially outer side forming an annular bevel surface along a radially outer edge. A retaining plate having an axially extending base, a radially extending outward arm and a radially extending inward leg having an annular bevel surface along an axially inner, radially inner edge is affixed to the disk and the leg cooperates with the lip of the ring. Wherein, the bevel surfaces of the retaining plate and retaining ring are arranged outwardly opposite to one another so that the bevel surfaces are radially compressed along each other as the base slidably engages with the recess walls.

6 Claims, 4 Drawing Sheets

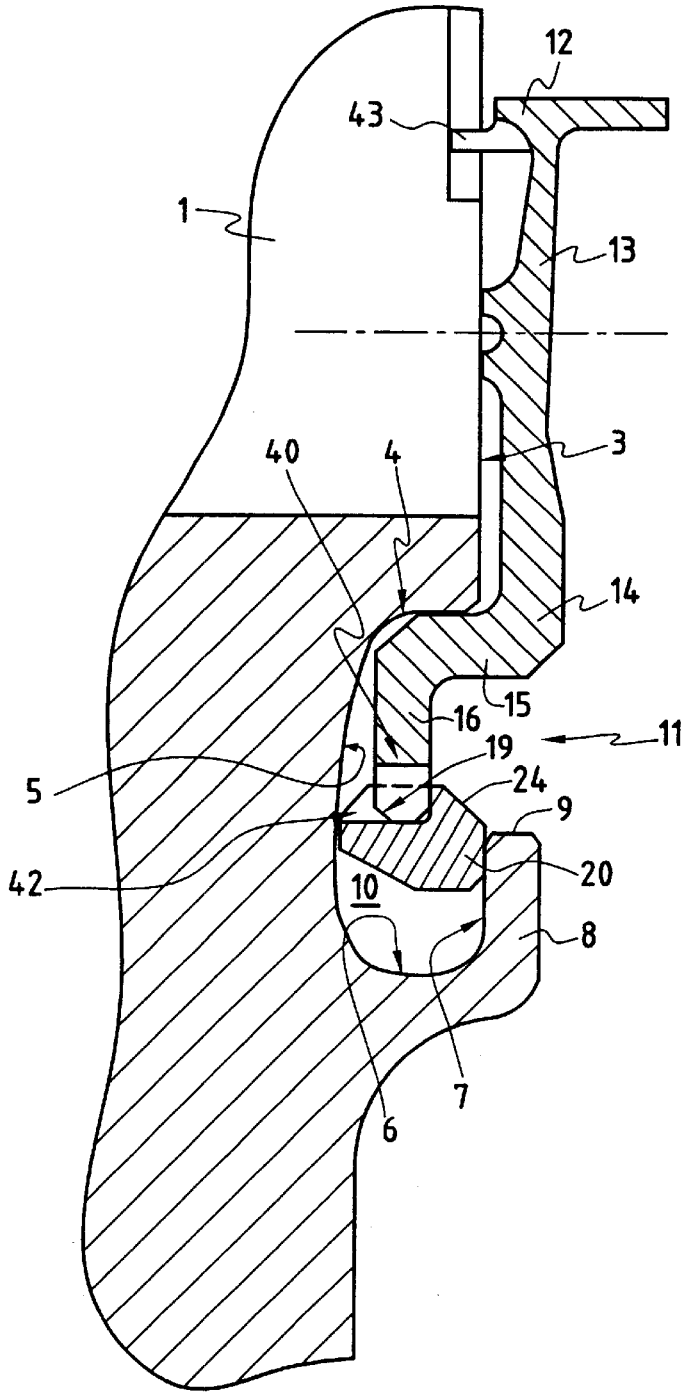
FIG.1
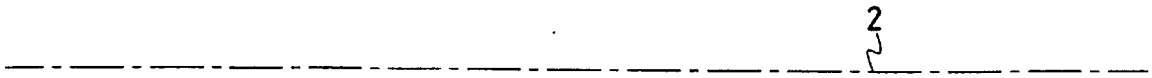

ROTOR BLADE RETAINING APPARATUS

BACKGROUND OF THE INVENTION

1. Field of the Invention

The present invention relates to an apparatus for retaining an annular plate against the radial surface of a disk for retaining rotor blades.

2. Description of the Prior Art

Boltless rotor blade retainers have been developed to reduce problems related to localized stress concentration in a rotor disk rim and blade retainers, reduce installation time and complications, and weight. Furthermore, they require additional tools.

One type of design is known in French Patent 2,485,117. It employs an annular retaining plate that is retained against a radial disk surface. The disk includes an annular recess formed along the radial surface that is bounded by several walls of which one is constituted by one side of a radially outwardly extending flange. The plate includes an axially extending base that is adapted to slidably engage with a radially outer wall of the recess. The plate also includes a leg extending radially inward to engage with the recess. The apparatus further includes an annular retaining ring that is disposed in the recess of the disk and is shaped to receive a portion of the leg which is also disposed within the recess to secure the blade retainer to the disk.

In order to install the retaining plate, the split annular retaining ring is inserted into the disk recess and compressed radially inward into the recess using compression tools disposed along the peripheral ring wall. Compression occurs until the tools come to rest against the flange. Next the base and the leg are inserted into the recess until a portion of the arm abuts the side of the disk. An axial force is applied to the retaining plate in order to urge the base and the leg to deflect inwardly, clearing the radially inner wall. A clamping tool is used to accomplish the deflection. At this point, the compression tools that compressed the annular ring are released. The ring then expands radially outward and the axial force applied to the retaining plate is released. Thereupon, the plate leg comes to rest against the two walls bounding the lip of the annular ring.

Accordingly, the use of the plate retaining device of the said French patent 2,485,117 entails special tools including the compression and clamping tools to compress the retaining ring when assembling the plate.

SUMMARY OF THE INVENTION

The objective of the present invention is an apparatus that axially engages the retaining plate and permits simple installation.

Another object of the invention is to enable assembling the retaining plate onto the disk without special tools that compress the retaining ring and deflect the retaining plate.

Still another objective of the invention is an apparatus that axially retains the plate and enhances the disk service life.

The invention attains its objectives in that the plate leg and the retaining ring form annular and mutually facing bevels to compress the ring previously placed in the recess when the base was made to slide axially in the recess as the plate was assembled to the disk.

Preferably the following design steps also shall be observed:

the bevels slant by an angle between 10 and 60° relative to the disk axis, the lip is bounded by a surface radially resting on the leg end and by a radial surface resting on the leg's side which faces the recess aperture, the radial surface leading to the retaining ring's bevel, the part of the leg received in the lip is fitted with notches, the lip comprises protrusions which will be inserted into the leg's notches, The notch depth is larger than the protrusion height.

The last design step allows slipping a tool into the space subtended between the protrusion peaks and the notch bottoms for the purpose of compressing the retaining ring when the plate is disassembled during maintenance operations. However, no special tool is used when reassembling the plate.

The geometry of the notches and protrusions allows keeping the retaining ring irrotational relative to the plate. This plate is thereby fixed in position relative to the disk at the level of the blade roots. With regard to the French patent 2,485,117, the retaining ring is affixed to the disk at a recess in the flange bounding the recess. Accordingly, such a recess is not required in the present invention and thereby disk construction is simplified and disk service life is extended.

Other features and advantages of the invention are elucidated in the illustrative description below which relates to the attached drawings.

DESCRIPTION OF THE DRAWINGS

FIG. 1 is a cross-sectional view of a rotor disk designed in the manner of the present invention.

DETAILED DESCRIPTION OF THE INVENTION

Figure 2A:
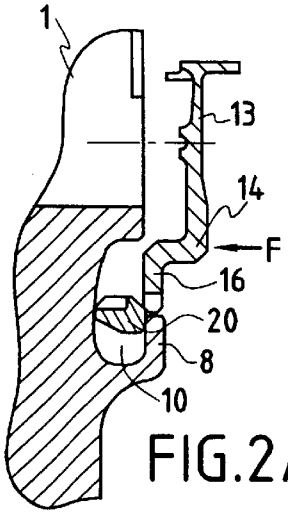
FIGS. 2*a*–2*f* are schematic, sequential steps of an installation operation employing the blade retainer structure of the invention.
Figure 2B:
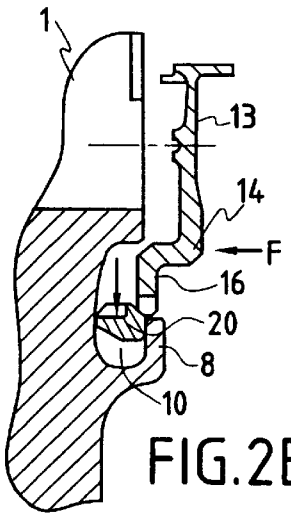
Figure 2C:
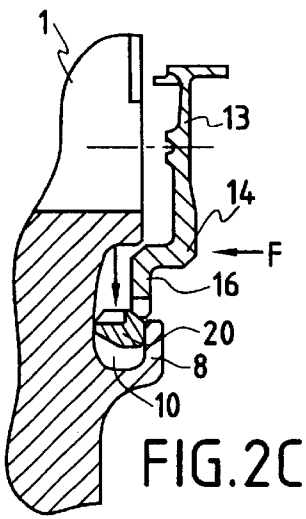

The drawings show an annular radially extending, rotor disk 1 of a gas-turbine engine with an axis of rotation 2. This disk 1 is fitted on its radial side 3 with a recess 10 bounded by a radially outer wall 4, an axially inner wall 5, a radially inner wall 6 and the axially outer wall 7 of a radially outwardly extending flange 8. The upper end 9 of the flange 8 is radially spaced away from the radially outer wall 4 in order to subtend an annular aperture 11 to access the recess 10. The disk 1 is fitted at its periphery with axial notches receiving omitted blade roots. These blade roots are axially held in place by the outside portion 12 of an annular plate 13 of which the radially inner portion 14 comprises an annular base 15 axially extending into the outside side of the recess 10 and a leg 16 radially extending from the inner end of the annular base 15 into the recess 10.

The outside diameter of the annular base 15 is substantially equal to the diameter of the radially outer wall 4 of the recess 10, and the annular base 15 rests for instance in sliding manner against this outside wall 4. The inside diameter of the leg 16 is larger than the outside diameter of the flange 8 to allow inserting both the annular base 15 and the leg 16 through the annular aperture 11 into the recess 10. When the radially inside part 14 of the plate 13 is inserted into the cavity 10, the plate 13 is radially kept in place relative to the disk 1 because the annular base 15 will rest for instance in sliding manner against the radially outer wall 4.

The plate 13 is axially held in place at the disk 1 by a split annular retaining ring 20. The retaining ring 20 comprises an axial front wall 21 resting against the inside surface 7 of the flange 8, further a rear wall 22 configured near the axially inside wall 5 of the recess 10, an outer peripheral wall 23 leading through a bevel 24 to the front wall 21 and by means of a lip 25 which is bounded by a radial surface 26 and a cylindrical surface 27 to the rear wall 22, and lastly an axially inside recess wall 6 of a size allowing compressively moving the retaining ring 20 behind the flange 8 when the plate 13 is put in place.

Figure 4:
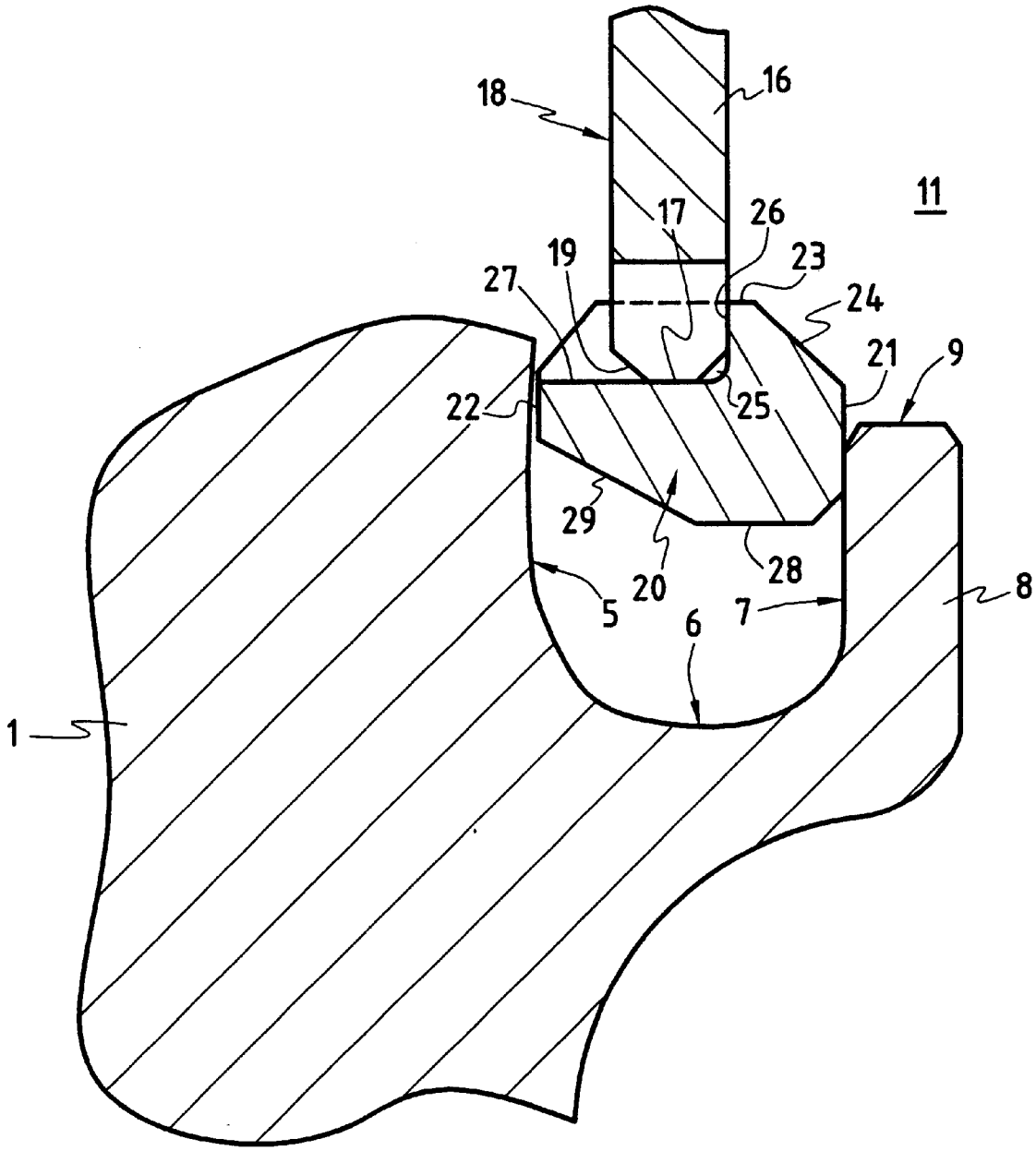
FIG. 4 is an enlarged cross-sectional view showing the base and leg of the retaining plate and the retaining ring in the recess.

In the assembly position shown in FIG. 4, the radial surface 26 bounding the lip 25 is compressed by the side of the leg 16 which is opposite the annular aperture 11.

The diameter of the cylindrical surface 27 bounding the lip 25 is substantially equal to the inside diameter of the leg 16 in the rest position of the retaining ring 20. However when the retaining ring 20 is subjected to centrifugal forces during the rotation of the disk 1, the cylindrical surface 27 presses against the inside end 17 of the leg 16.

The inside diameter of the leg 16 also is substantially equal to the outside diameter of the front wall 21 of the retaining ring at rest.

Furthermore the inner end 17 of the leg 16 also leads through a bevel 19 to the rear side 18 of the leg 16 configured opposite the axially inner wall 5 of the recess 10.

This bevel 19 and the bevel 24 of the retaining ring 20 exhibit identical angles relative to the axis of rotation 2 of the disk 1. The angles are between a range of 10 and 45°.

The axially inside wall 28 of the retaining ring 20 also leads through a second bevel 29 to the rear wall 22. The bevel 29 allows the retaining ring 20 to expand when it is inserted into the recess 10.

FIGS. 2*a* through 2*f* show the different assembly stages of the plate 13 onto the disk 1. The split angular retaining ring 20 is inserted into the recess 10 wherein it assumes its rest position shown in FIG. 2.

Next the plate 13 is positioned in such a way that the end 17 of the leg 16 is situated in the aperture 11 of the recess 10. Thereupon, the bevel 19 of the leg 16 rests against the bevel 24 of the retaining ring 20 which thus can be centered relative to the axis of rotation 2 of the disk 1. Next, an axial force F is applied to the inside portion 14 of the plate 13. This manoeuver compresses the retaining ring 20 in the manner shown in FIGS. 2*b*, 2*c* and 2*d* and forces the annular base 15 to slide on the radially outer wall 4 of the recess 10.

Figure 2D:
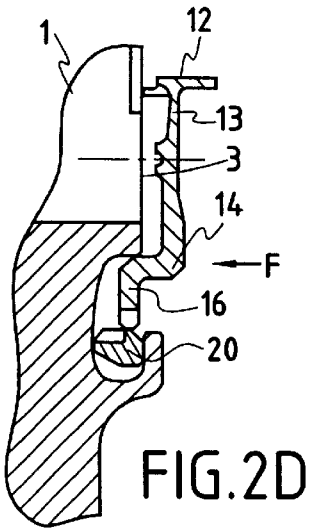
Figure 2E:
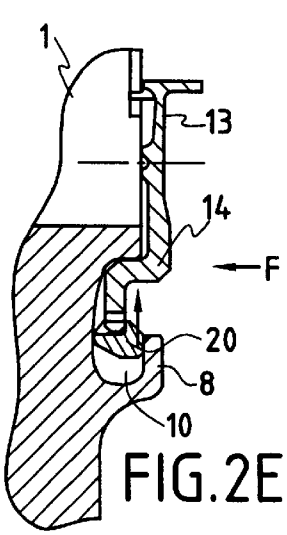
Figure 2F:
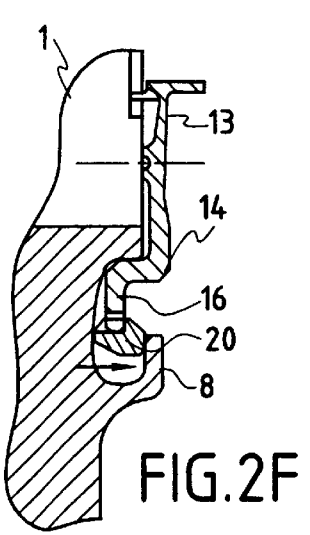

FIG. 2*d* shows that the leg end 17 rests in sliding manner against the outer peripheral wall 23 of the retaining ring. An axial force F is further applied to the inside portion 14 of the plate 13. The outside portion 12 of the plate 13 comes to rest against the radial side 3 of the disk 1 and against the blades, and the end 17 of the leg 16 moves above the lip 25 (see FIG. 4 for details of the lip). As a result, the retaining ring 20 is relieved of compression and it resumes its intrinsic diameter. The cylindrical surface 27 of the lip 25 comes to rest against end 17 of the leg 16 and the radial surface 26 moves between the leg 16 and the aperture 11. When the axial force F applied to the inside portion 14 of the plate 13 is relaxed, the plate compresses the radial surface 26 bounding the lip 25 and the front surface 21 of the retaining ring 20 rests against the inside surface 7 of the flange 8.

It should be noted that the plate 13 is mounted in axially prestressed manner on the disk 1.

As described above, the axial displacement of the plate 13 when assembled to the disk 1 entails compressing the retaining ring 20 by means of the bevels 19 and 24.

On the other hand, to retract the plate 13, the retaining ring 20 must be compressed beforehand in order that its outer peripheral wall 23 move from beneath the end 17 of the leg 16.

Figure 3:
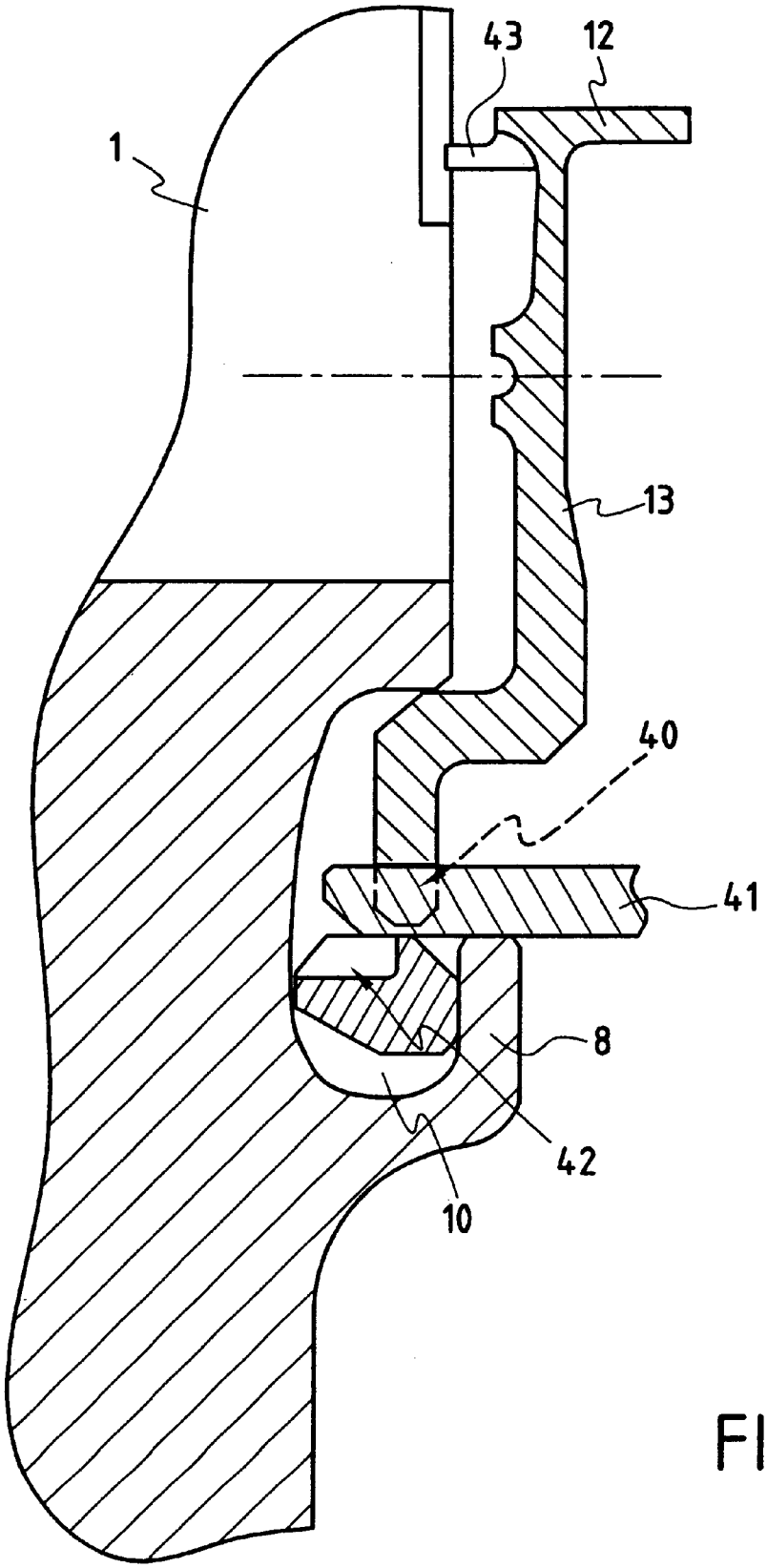
FIG. 3 is a cross-sectional view of FIG. 1 in the first plate dismantling stage.

In order to make this operation easier, the leg 16 is fitted with a plurality of notches 40 of which the bottom is directed away from the axis of rotation 2 by a distance larger than the diameter of the outer peripheral wall 23 of the retaining ring 20. In this manner the end of a suitable tool 41 can be slipped through the interstice in the manner shown in FIG. 3 in order to compress the retaining ring 20.

Advantageously, the retaining ring 20 is fitted with protrusions 42 formed along the leg 25 and corresponding to the notches 40. The protrusions 42 are inserted into the notches 40 and their outer surfaces are flush with the outer peripheral wall 23 of the retaining ring 20. The protrusions 42 improve the support to the tools 41 and further retain the retaining ring 20 irrotational relative to the plate 13. The outside portion 12 of the plate 13 in this instance is fixed in a position relative to the disk 1 using appropriate means, for instance studs 43, which enter between two blade roots.

The design of notches 40, protrusions 42 and studs 43 allows rotational affixation of each other to the disk 1, plate 13 and retaining ring 20 in the absence of a direct device blocking relative rotation between the retaining ring 20 and the disk 1. This design circumvents the presence of stresses entailed by the splits in the flange 8 of the disk 1. In this manner the mechanical strength of the disk 1 is preserved and its service life is extended.

We claim:

1. An apparatus for axially retaining rotor blades carried by an annular disk of a turbine engine, the disk extending radially outward relative to a longitudinal axis of the engine, said disk forming an annular recess defined by radial inner and outer walls radially spaced from one another relative to the engine axis, and axial inner wall and outer walls axially spaced from one another relative to the center of the disk perpendicular to the engine axis, the axial outer wall defined by a side of a radially outwardly extending flange formed by said disk, said apparatus comprising:

an annular retaining plate forming an axially extending base generally parallel to the engine axis, an arm extending radially outward from said engine axis from an outer side of said base directed away from the disk center, and a leg extending radially inward towards said engine axis from an inner side of said base directed towards the disk center, said leg having an annular bevel surface along an inner edge directed towards the disk center and the engine axis, said base and said leg disposed in said recess, and said base configured and dimensioned to slidably engage with said radial outer wall of said recess; and an annular retaining ring disposed in said recess and configured and dimensioned to abut the axial outerwall thereof, said retaining ring having an axial outer end with an outer side positioned generally parallel to and axially away from the disk center, and forming an annular bevel surface along a radial outer edge directed away from the disk center and the engine axis, said retaining ring also forming a lip extending generally parallel to the engine axis and bounded by the outer end of the ring, and an axial inner end wedged against said axial inner wall of the disk, said lip configured and dimensioned to receive a radial inner portion of said leg directed towards the engine axis for thereby securing said retaining plate to said disk;

wherein said bevel surfaces of said retaining plate and said retaining ring are configured and dimensioned such that said bevel surfaces cooperate to compress the retaining ring in the recess when the bevel surface of the retaining plate slidably presses against the bevel surface of the retaining ring as the base is inserted into the recess.

2. The apparatus according to claim 1 wherein the bevel surfaces of said retaining plate and said retaining ring are positioned at an angle in a range between about 10 and 60 degrees relative to the axis of rotation of the disk.

3. The apparatus according to claim 1 wherein the lip is defined by an axial surface extending parallel to the engine axis and an intermediate radially extending surface forming an inner side of the outer end of the retaining ring, the radial inner portion of said leg directed towards the engine axis being retained by said axial surface of said lip and said inner side of the outer end of the ring when disposed in said recess.

4. The apparatus according to claim 1 wherein said leg forms a plurality of notches the radial inner portion of said leg directed towards the engine axis.

5. The apparatus according to claim 4 wherein said lip forms a plurality of protrusions adapted to engage with said plurality of notches of the radial inner portion of said leg.

6. The apparatus according to claim 5 wherein the depth of said notches is greater than the width of said protrusions.

* * * * *